United States Patent [19]

Allen

[11] 4,315,625

[45] Feb. 16, 1982

[54] SHUFFLEBOARD CUE WITH SELECTIVELY FIXED OR SWIVELLED WEIGHTED RUNNER

[75] Inventor: Samuel H. Allen, Seminole, Fla.

[73] Assignee: Allen R. Shuffleboard Company, Seminole, Fla.

[21] Appl. No.: 970,029

[22] Filed: Dec. 15, 1978

[51] Int. Cl.[3] ..... A63B 71/00; A63B 67/14

[52] U.S. Cl. ..... 273/129 L

[58] Field of Search ..... 273/126 R, 129 R, 129 L, 273/87.2, 72 R, 26 B; 403/159, 157; 15/147 A, 147 B, 147 C; 46/221

[56] References Cited

U.S. PATENT DOCUMENTS

| | | | |
|---|---|---|---|
| 2,144,846 | 1/1939 | Kruspe | 273/26 B |
| 2,239,391 | 4/1941 | Krause | 273/29 L |
| 2,305,562 | 12/1942 | Thompson et al. | 403/159 |
| 2,805,068 | 9/1957 | Herzer | 273/129 L |
| 3,116,926 | 1/1964 | Owen et al. | 273/26 B |
| 4,185,827 | 1/1980 | Allen | 273/129 B |

*Primary Examiner*—Anton O. Oechsle
*Assistant Examiner*—T. Brown
*Attorney, Agent, or Firm*—Griffin, Branigan & Butler

[57] ABSTRACT

A shuffleboard cue head for propelling a disc along a cue board is provided with snap-on, detachable, weighted runners capable of being affixed to the cue head in a first position which allows the runner to pivot or a second position in which the runner is fixed. A runner, which may take a variety of geometric forms and may include weights of varying size, is mounted between a pair of cantilevered, resilient members situated at the forward end of the cue. The pair of resilient members urges a connection arrangement into engagement with the runner to attach the runner to the cue head without the assistance of tools or the like.

11 Claims, 6 Drawing Figures

SHUFFLEBOARD CUE WITH SELECTIVELY FIXED OR SWIVELLED WEIGHTED RUNNER

BACKGROUND OF THE INVENTION

This invention relates to a device for use in playing the game of shuffleboard and more particularly to a cue head having weighted replaceable runners capable of being either rigidly or pivotally affixed to a frame. The present invention resides in improvements in replaceable runners of the type disclosed in the application of Earl G. Caunter, Ser. No. 970,030, filed concurrently herewith and assigned to the assignee of the present application.

In shuffleboard, a player propels a disc along a court toward a scoring diagram utilizing a cue having a head which contacts and directs the disc during each propelling operation. Since the accuracy of a shot depends upon the player's precise aim and ability to impart the correct amount of force to the disc, the structure and condition of the head become important when the game is played with skill.

Such design factors as the lateral spacing between runners, the condition of the runners resulting from extended wear, the weight of the cue head, the manner in which the runners engage the disc, and the effect of friction between the cue head and the court all contribute to the player's control during each disc propelling operation. In addition, external factors such as wind play an important part in control. The shuffleboard cue heads disclosed in the aforementioned application and in U.S. Pat. Nos. 2,239,391, 2,435,855, and 2,805,068 illustrate a variety of prior art structures which are intended to provide better player control.

A drawback of the prior art cue heads relates to their lack of versatility. A player may find a particular structure well adapted for a specific type of shot and inadequate for another. In addition, many of the prior art cue heads have complicated structures which are expensive to produce and require the use of tools to maintain. Others are too light and, in order to provide additional weight, players frequently wrap solder wire around the cue stick near the head.

SUMMARY OF THE INVENTION

It is an object of this invention to provide a shuffleboard cue head which has diverse features for improving a player's control.

Another object of this invention is to provide a shuffleboard cue head having weighted runners which can be replaced without the use of tools.

Yet another object of the invention relates to a shuffleboard cue head adapted to accommodate runners having a variety of geometric forms and weights.

A further object of the invention pertains to a shuffleboard cue whereby the user can adjust the weight of the cue by the selective use of weighted runners.

Another object of the invention is to provide a shuffleboard cue head having replaceable runners which can be rigidly or pivotally affixed to a frame as desired, without the aid of tools.

In accordance with the principles of the present invention, a shuffleboard cue head comprises a U-shaped frame including laterally spaced, forwardly extending forks which carry replaceable runners that snap-on in place. The runners are capable of being affixed to the frame in a first position which allows the runners to pivot or a second position which rigidly attaches the runners to the frame. In addition, the runners may take a variety of different geometric forms and may include weights of varying size to permit a player to selectively adjust the weight of the cue head as desired.

BRIEF DESCRIPTION OF THE DRAWINGS

The foregoing and other objects, features and advantages of the invention will become apparent from the following more particular description of the preferred embodiments of the invention, as illustrated in the accompanying drawings in which like reference numerals refer to the same parts throughout the different views. The drawings are not necessarily to scale, emphasis instead being placed upon illustrating the principles of the invention.

DESCRIPTION OF THE PREFERRED EMBODIMENTS

Figure 1:
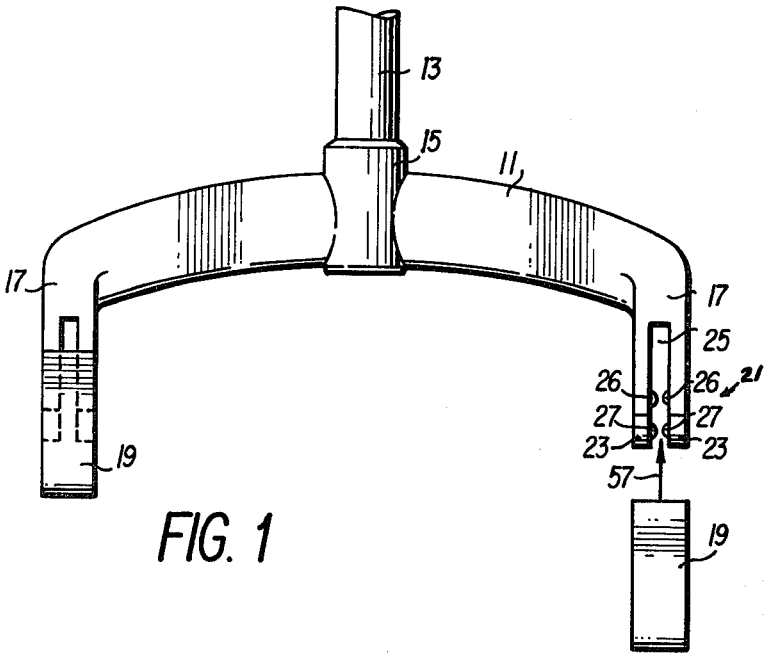
FIG. 1 is a top view of a cue head with one runner attached and one removed.

A shuffleboard cue head as illustrated in FIG. 1 comprises a U-frame 11 attached to a shaft 13 by a coupling arrangement 15. The frame 11, which preferably is constructed from molded plastic, includes a pair of laterally spaced, forwardly extending arms 17 which carry detachable, weighted, snap-on runners 19 adapted to engage the peripheral edge of a shuffleboard disc.

At the forward end of each arm 17 is a snap-on connection arrangement, seen generally at 21, and comprising a pair of cantilevered, resilient members 23 which are laterally spaced from one another to form a recess 25 for receiving a runner 19. Each resilient member 23 has two hemispherical protrusions or beads 26 and 27 extending from the surface facing the other resilient member.

Figure 3:
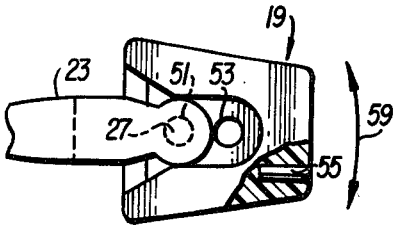
FIG. 3 is a side view showing a runner attached in the pivotal position.

Referring to FIG. 3, each resilient member 23 is capable of limited flexural movement toward and away from the sides of runner 19. As used herein, resilient is intended to mean that a member 23 is capable of being slightly flexed in response to a force tending to move it away from the other member 23, but returns to its initial position upon removal of the force.

Figure 2:
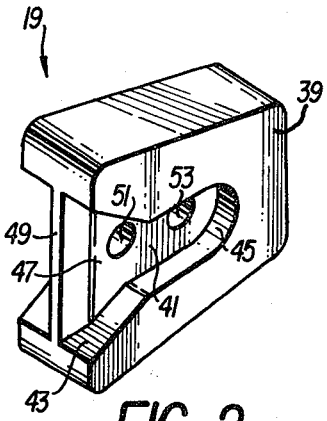
FIG. 2 is a perspective view of a snap-on runner.

The selectively fixed or swiveled, weighted runner 19 illustrated in FIG. 2 includes a main body having a suitable geometric form such as a keystone. Opposing sides 39 of the runner 19 include a recess 41 comprising a wedge-shaped portion 43 leading into a slot-shaped portion 45. The recesses 41 leave a web 47 which is provided with a beveled edge 49 and first and second apertures 51 and 53 respectively. The apertures 51 and 53 both have diameters slightly larger than the beads 26 and 27. In order to facilitate a secure coupling of the runner 19 to the snap-on connection arrangement 21, the thickness of the web 47 should exceed the lateral spacing between the pairs of beads 26 and 27, but should be less than the lateral distance between the flat surfaces of resilient members 23.

Also included integral with the runner is a weight 55 (FIG. 3) which is positioned at the forward-most portion of the runner 19. The weight 55 may be installed in the runner 19 by drilling a hole of suitable size, depending on the amount of weight to be added, and press-fitting into the hole a brass, lead, or another suitable plug.

By locating the weight 55 in the runner 19 near the forward-most end of the cue head, cue head vibration or jumping is greatly reduced and the added weight is helpful in keeping the cue head firmly on the court during windy conditions. Additionally a player can easily change the weight of the cue head to suit his needs by selecting a set of runners having particular weight therein. This represents an improvement over prior art weights which snap onto the cue shaft 13 or are soldered to the head.

In order to pivotally attach a runner 19 to the snap-on connection arrangement 21, the runner is moved in the direction of arrow 57 (FIG. 1) so that the beveled edge 49 of the web 47 moves into the recess 25 between resilient members 23. As the runner 19 is slid into the recess 25 the beads 27 contact the web portion 47. Since the thickness of the web 47 exceeds the lateral spacing of the beads 27, the resilient members 23 are urged apart and placed under stress.

As the runner 19 is moved further into the recess 25, the peripheral surfaces of recess 41 guide the resilient member 23 such that beads 27 are aligned with the first aperture 51 of runner 19. Since the resilient members 23 are under stress, they exert a restoring force substantially normal to and towards the surface of the web 47. Therefore, the beads 27 are urged into engagement with the aperture 51 and are retained in place due to the resilient nature of the members 23. The wedge-shaped portions 43 of recess 41 allow the runner 19 to pivot about an axis extending through beads 27, as indicated by arrow 59 in FIG. 3.

Figure 4:
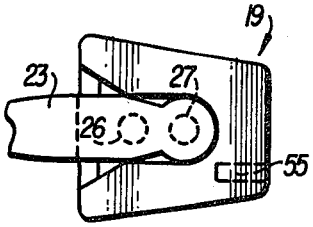
FIG. 4 is a side view showing the runner of FIG. 2 in a fixed position.

The runner 19 may also be rigidly or non-pivotally affixed to the snap-on connection means. This is accomplished by sliding the runner 19 further into the recess 25 until the beads 27 engage the second aperture 53 while beads 26 engage aperture 51. With beads 26 and 27 seated in apertures 51 and 53 as shown in FIG. 4, the runner does not freely pivot but remains fixed relative to the cue head.

Removal of a runner 19 may be accomplished merely by pulling frame 11 and the runner in opposite directions. Removal may be facilitated by slightly twisting the runner 19 thereby forcing the resilient members 23 apart so that beads 26 and 27 more easily slide out of, and disengaged from, the apertures, as the runner and frame 11 are pulled in opposite directions.

Figure 5:
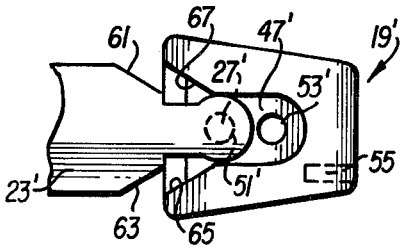
FIG. 5 shows another embodiment of a replaceable runner.
Figure 6:
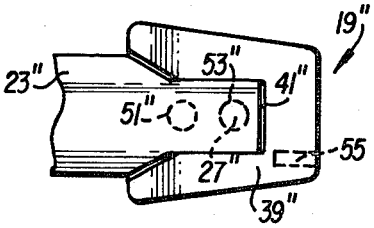
FIG. 6 shows still another embodiment of a replaceable runner.

FIGS. 5 and 6 illustrate alternative embodiments wherein a weighted runner may be either fixed or pivoted using only one pair of beads on the resilient members. In the embodiment of FIG. 5, the runner 19' is provided with two holes 51' and 53' extending through the web portion 47'. The resilient members 23' are provided with a pair of beads 27', one bead on each member 23' on the surface facing web 47'. When it is desired to have a pivoting runner, the runner is inserted between resilient members 23' so that beads 27' are seated in hole 51'. When it is desired to have a fixed runner, it is inserted still further between resilient members 23' so that beads 27' are seated in hole 53'. In this position, the surfaces 61 and 63 on each resilient member 23' engage surfaces 65 and 67 on runner 19' to prevent pivoting movement.

The embodiment of FIG. 6 is similar to that of FIG. 5 in that only a pair of beads 27'', are provided, one bead on each resilient member 23''. However, the end portions of resilient members 23'' are made generally rectangular and only slightly smaller than a generally rectangular recess 41'' formed in the opposite surfaces 39'' of the runner. When the runner 19'' is inserted between resilient members 23'' so that beads 27'' are seated in holes 53'', (see FIG. 6) the mating configurations of recess 41'' and the end portions of resilient members 23'' prevent the pivoting of the runner. However, when the runner is affixed to the resilient members 23'' with beads 27'' seated in holes 51'', there is sufficient clearance between the resilient members and the side walls of recess 41'' to permit pivoting movement of the runner about an axis extending through beads 27''.

While the invention has been particularly shown and described with reference to preferred embodiments thereof, it will be understood by those skilled in the art that various changes in form and detail may be made therein without departing from the spirit and scope of the invention as defined by the appended claims. For example, the apertures 51 and 53 need not extend entirely through the web portion but may instead comprise four recesses, two on each face of the web. Alternatively each resilient, cantilevered member may include an aperture in lieu of a bead, in which case each runner would include corresponding beads adapted to engage the aperture associated with the resilient members.

I claim:

1. A shuffleboard cue head for propelling a disc along a shuffleboard court comprising:

a frame for mounting to a handle, said frame having forwardly extending, laterally spaced arms which carry detachable runners;

said arms including connection means for detachably affixing said runners to said frame; and said connection means including means for attaching said runners to said frame in a first position which allows said runners to pivot or a second position which rigidly attaches said runners to said frame.

2. The cue head as claimed in claim 1 wherein said connection means includes:

a pair of laterally spaced, cantilevered, resilient members including runner-engaging means for attaching one of said runners between said pair of said members; and said resilient members urging said runner-engaging means into engagement with said runner when said runner is positioned between a pair of said members.

3. The cue head as recited in claim 1 or claim 2 wherein said runners are formed with a main body having a suitable geometric form and a web portion having a thickness less than said main body.

4. The cue head as recited in claim 1 or claim 2 wherein a web portion of said runners includes a wedge-shaped portion and a slot portion.

5. The cue head of claim 2 wherein said runner-engaging means comprises a pair of protrusions which are laterally spaced from one another at a distance less than the width of a web portion of said runners.

6. The cue head of claim 2 wherein each of said runners include first and second recesses;

said first recess being positioned to allow said runner to pivot when said runner-engaging means is urged into engagement with said first recess by said resilient members; and, said second recess being positioned to statically attach said runner when said runner-engagement means is urged into engagement with said second recess.

7. The cue head of claim 2 wherein said runner-engaging means comprises a pair of protrusions which are laterally spaced at a distance less than the width of a web of said runners.

8. A shuffleboard cue head comprising:

a forked frame having means to mount said fork to a handle;

said frame including forwardly extending laterally spaced arms which carry snap-on detachable runners;

each of said runners being attached to each of said arms by a snap-on attachment means; and, said snap-on detachable runners being attached to said frame in a first position which allows said runners to pivot and a second position which rigidly attaches said runners to said frame.

9. The cue head of claim 8 wherein said snap-on attachment means includes a pair of cantilevered, resilient members having said runner snap-on attachment means.

10. The cue head of claim 8 wherein said resilient members urge said attachment means into engagement with said runner to provide a snap-on attachment.

11. The cue head of claim 1 or 8 wherein said runner includes a weighting means which is formed as an integral portion of said runner.

* * * * *